United States Patent [19]

Ohtsuka et al.

[11] Patent Number: 4,622,915

[45] Date of Patent: Nov. 18, 1986

[54] DEVELOPING HEAD OF ELECTROPHOTOGRAPHIC SYSTEM

[75] Inventors: Shuichi Ohtsuka; Akinori Kimura, both of Kanagawa, Japan

[73] Assignee: Fuji Photo Film Co., Ltd., Kanagawa, Japan

[21] Appl. No.: 678,819

[22] Filed: Dec. 6, 1984

[30] Foreign Application Priority Data

Dec. 9, 1983 [JP] Japan ..... 58-231498

[51] Int. Cl.[4] ..... G03G 15/10

[52] U.S. Cl. ..... 118/652; 118/662; 355/10

[58] Field of Search ..... 118/647, 662, 652; 354/323; 355/10

[56] References Cited

U.S. PATENT DOCUMENTS 3,342,164 9/1967 Lewis ..... 118/652

3,936,854 2/1976 Smith ..... 355/10 X

*Primary Examiner*—Evan K. Lawrence

[57] ABSTRACT

In a developing head of an electrophotographic system which develops an image by bringing a liquid developer into contact with a photosensitive face of electrophotographic material, through an opening provided in the developing head, a right angle is formed between the photosensitive face and the in-flow and out-flow route for the liquid developer and a gas for removing excess developer at the opening. A pressure-reducing chamber is formed between a frame around the opening and a frame surrounding the pressure-reducing chamber, both frames tightly contacting the electrophotosensitive material. Thus, the gap between the photosensitive face and a developing electrode is reduced and high speed for the gas for removing the developer is obtained. Liquid developer exuding from the frame around the opening is captured in the pressure-reducing chamber.

10 Claims, 10 Drawing Figures

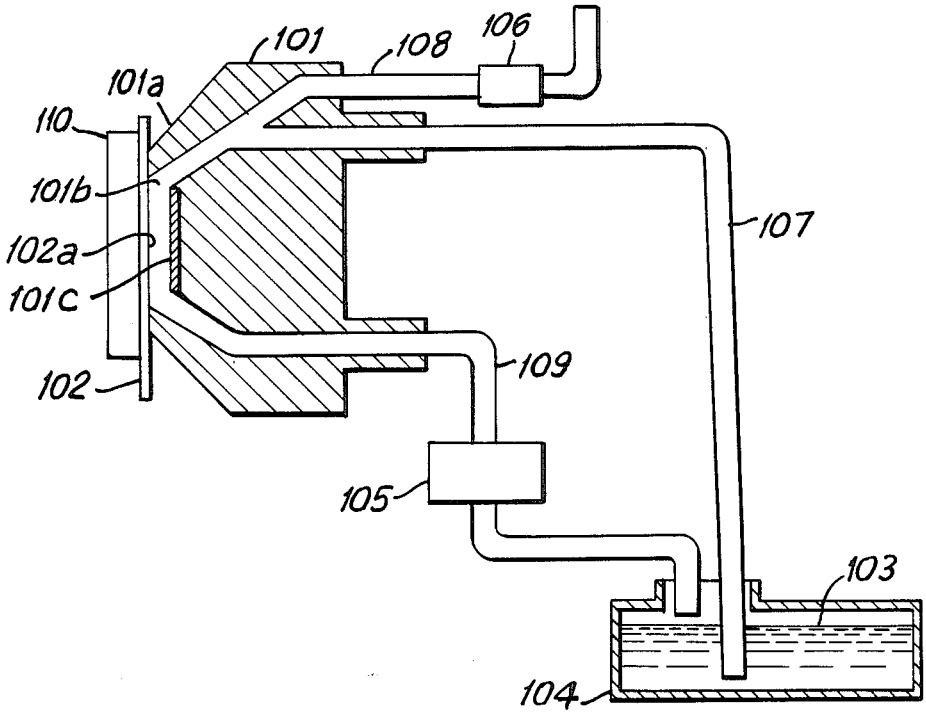
FIG. 1-a (PRIOR ART)
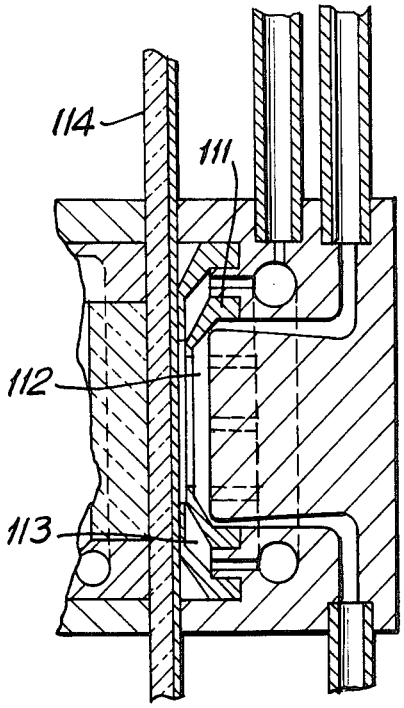
FIG. 1-b (PRIOR ART)

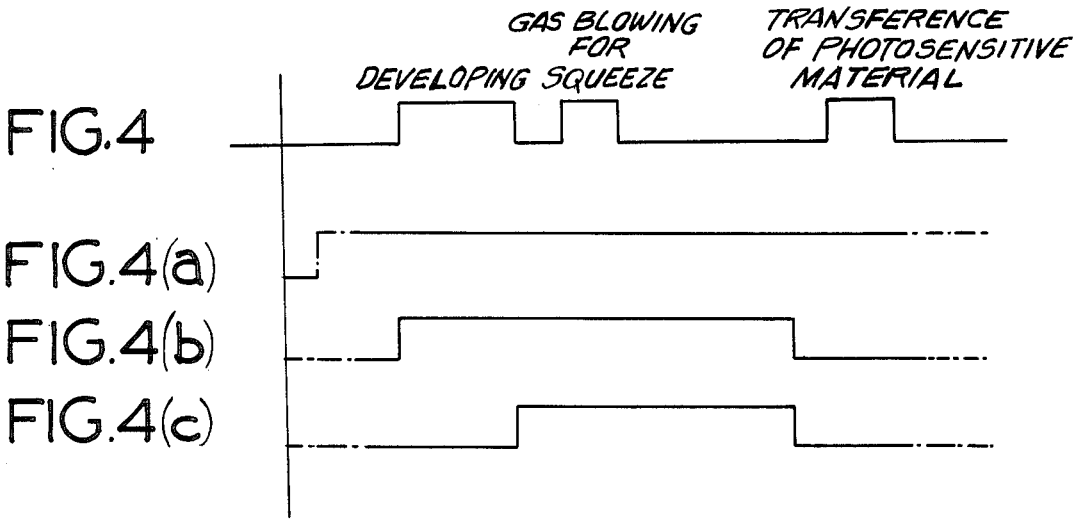
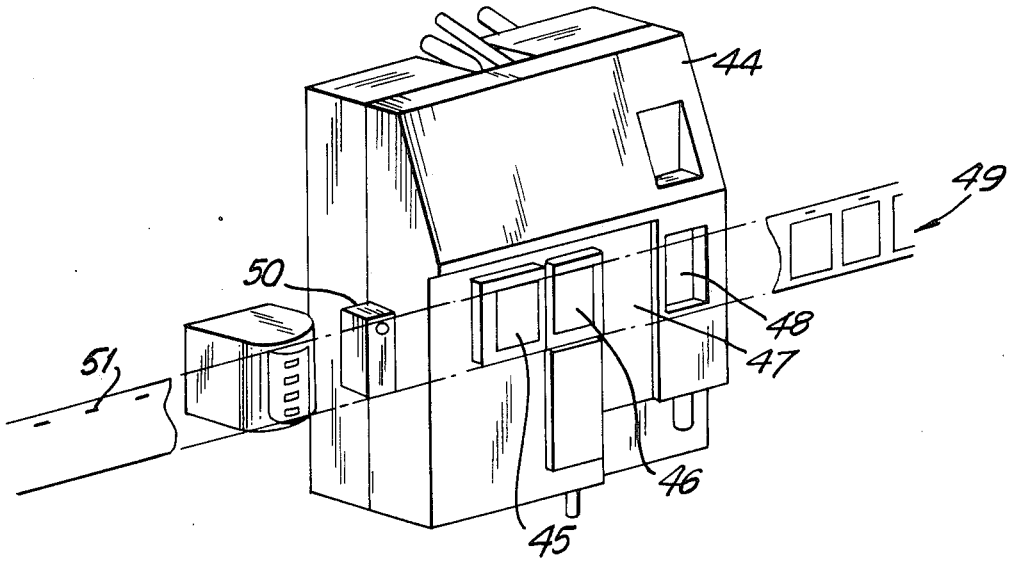
FIG. 6

DEVELOPING HEAD OF ELECTROPHOTOGRAPHIC SYSTEM

BACKGROUND OF THE INVENTION

Field of the Invention

This invention relates to the developing head of an electrophotographic system and to means at the head for removing liquid developer after development.

Description of the Prior Art

Electrophotosensive material achieves photosensitivity only by electrostatic charge unlike the conventional silver-halide photosensitive material. Electrophotosensitive material is formed into a long roll film or fiche film. Thus only a specified part records the picture-image by performing electrostatic charging, exposure to light, development, drying and fixing. Then, this image is utilized by projection in the use of leaders, etc.

It is used as microfilm for adding new records to non-recorded parts.

Among electrophotographic systems using the above mentioned electrophotosensitive material, the so-called wet electrophotographic system performs electrostatic charging, exposure to light, development and fixing for each frame of material. Thereby, liquid developer must not move towards areas other than the image of the picture of photosensitive material after development.

It is therefore necessary to remove the excess liquid-developer by squeezing, i.e. forcing it from the development area before moving to the next processing step by separating the developing head from the photosensitive material.

Now, the developing head of an electrophotographic system related to the conventional technologies as disclosed by U.S. Pat. No. 3,916,828 and U.S. Pat. No. 3,927,639, which use liquid developer will be described, based on FIG. 1-*a*.

As shown in this figure, the developing head 101 is provided with the mask 101*a* for engaging photosensitive material 102.

Mask 101*a* has an opening 101*b* of an area corresponding to one frame of photosensitive material 102, and a developing electrode 101*c* confronts photosensitive face 102*a* of photosensitive material 102.

Photosensitive face 102*a* of one frame of photosensitive material 102 faces opening part 101*b*. Through opening part 101*b*, liquid developer 103 is supplied to the photosensitive face 102*a*, thus the latent image formed on photosensitive face 102*a* is developed.

Following such development, it is necessary to squeeze out liquid developer 103 attached to the photosensitive face 102*a*, by supplying a gas such as air to photosensitive face 102*a* through the opening 101*b*.

It is necessary to send liquid developer 103 up to opening part 101*b*.

Liquid developer 103 is transferred by suction of liquid developer 103 stored in tank 104 by vacuum pump 105. Also, gas (air) can be transferred by the suction of air from the atmosphere through opening valve 106 by vacuum pump 105. That is, developing head 101 is provided with flow route 107 from tank 104 to the inside of the developing head 101; flow route 108 joining route 107 upstream of opening part 101*b* and reaching the inside of the developing head 101 through valve 106 from the end open to the atmosphere; and flow route 109 returning to tank 104 through the vacuum pump 105 from opening part 101*b*.

At developing head 101 of this electrophotographic system, the latent images are formed on photosensitive face 102*a* by supplying the sucked liquid developer 103 from vacuum pump 105 to photosensitive face 102*a*, followed by the similar supply of sucked air from vacuum pump 105 on the photosensitive face 102*a* for removing the developer.

When the developing and removing processes are completed, the pressure by the holding plate 110 against photosensitive material 102 is released, thus photosensitive material 102 is advanced by one frame of the material.

In the above mentioned conventional technology, liquid developer 103 is transferred by a suction system; thus less liquid exudes from the developing part, but the cost of suction-means such as vacuum pump 105 is high, and although gas (air) for removal is supplied to photosensitive face 102*a*, this removal effect is not enough. Sufficient removal is possible by allowing enough time, but processing capacity per unit hour decreases.

Moreover, if there is a small gap due to poor working accuracy on the mask surface due to a scar on the surface of mask 101*a* or dust between mask 101*a* and photosensitive material 102, then, air enters through such a space, and developing cannot be made uniformly.

To prevent this problem, the precision of the surface of mask 101*a* should be increased.

To remove the remaining liquid developer 103 more efficiently, it is desirable to make the gas (air) flow into the developing chamber at a higher speed e.g. over 2 m/sec.

For this purpose, higher speeds of gas (air) can be obtained by the same blowing means with the reduction of the gap between the developing electrode 101*c* and photosensitive face 102*a* of photosensitive material 102 in the developing chamber.

When this gap is over 1 mm, there may arise a stagnating point of gas (air) which flows in the developing chamber, resulting in reduced space for removing the liquid developer 103.

Moreover, the gap in the developing chamber is related to the developing speed, and the gap should be as small as possible for developing up to enough concentration within a short time.

In the above mentioned conventional technology the flow-rate area of gas (air) and liquid developer 103 is inclined towards the photosensitive face of photosensitive material 102; thus, when the size of developing electrode 101*c* or opening part 101*b* is made constant, there is a problem of a bigger gap at the developing chamber.

Also, when liquid developer 103 flows into the developing chamber, image-concentration is known to be reduced at the area directly in contact with photosensitive face 102*a*. However, in the above mentioned conventional technology, liquid developer 103 flows at an angle to photosensitive face 102*a*, so there is a problem of an enlarged area in direct contact with photosensitive face 102*a*.

In view of the disclosed conventional technology in U.S. Pat. No. 3,936,854, as shown in FIG. 1-*b*, a developing head is provided with a developing chamber 112 surrounded by an elastic mask member 111 on its circumference, and a compression chamber 113 for sending the pressurized air to the surrounding area. This is to improve the removal efficiency by returning the liquid development remaining near the elastic mask member 111 due to a surface tension of the developer into the developing chamber by means of compressed air.

In the developing process, elastic mask member 111 acts as a sealing member of liquid developer by tight attachment to photosensitive material 114, and in the removal process, it forms a space with photosensitive material 114, from which air should be introduced; thus, it is necessary to manufacture it with an elastic material. However, in general, elastic material lacks durability and anti-solubility, so there are problems in that cleaning is impossible by a solvent, or the elastic material must be replaced frequently.

Furthermore, an additional problem of higher cost and a complicated manufacturing method may arise by the use of elastic material at the mask part alone.

SUMMARY OF THE INVENTION

The objective of this invention is to provide a developing head for a low-cost electrophotograhic system able to remove developer sufficiently within a short time.

Also, this invention is intended to realize more favorable image (picture) formation even in the unfavorable conditions of mask flatness or dust.

Another objective of this invention is to simplify manufacture and maintenance by making the mask-formation possible with hard materials without using any non-durable and unreliable elastic mask materials.

To achieve the above objectives in this invention, an opening is provided in front of the photosensitive face of electrophotosensitive material. Development takes place by making liquid developer contact the above mentioned photosensitive face at the developing head of the electrophotographic system through this opening.

At this developing head, the in-flow or out-flow route of the gas (air) and liquid developer is formed at right angles to the photosensitive face of the electrophotosensitive material. A pressure-reducing chamber is formed between the surrounding frame and the opening frame by having the surrounding frame closely touching the electrophotographic material on the outside of the opening frame at the above mentioned opening.

The above and other objectives of the invention will be seen in reference to the description accompanying the drawings.

BRIEF DESCRIPTION OF THE DRAWINGS

FIGS. 1-*a* and 1-*b* show sectional views of conventional processing heads.

FIG. 4 is a control graph showing the timing of suction at the pressure-reducing chamber.

FIG. 6 is a perspective view of a preferred one-piece electrophotographic processing head using this invention.

DESCRIPTION OF THE PREFERRED EMBODIMENTS

An embodiment of this invention will now be described based on the drawings.

Figure 2:
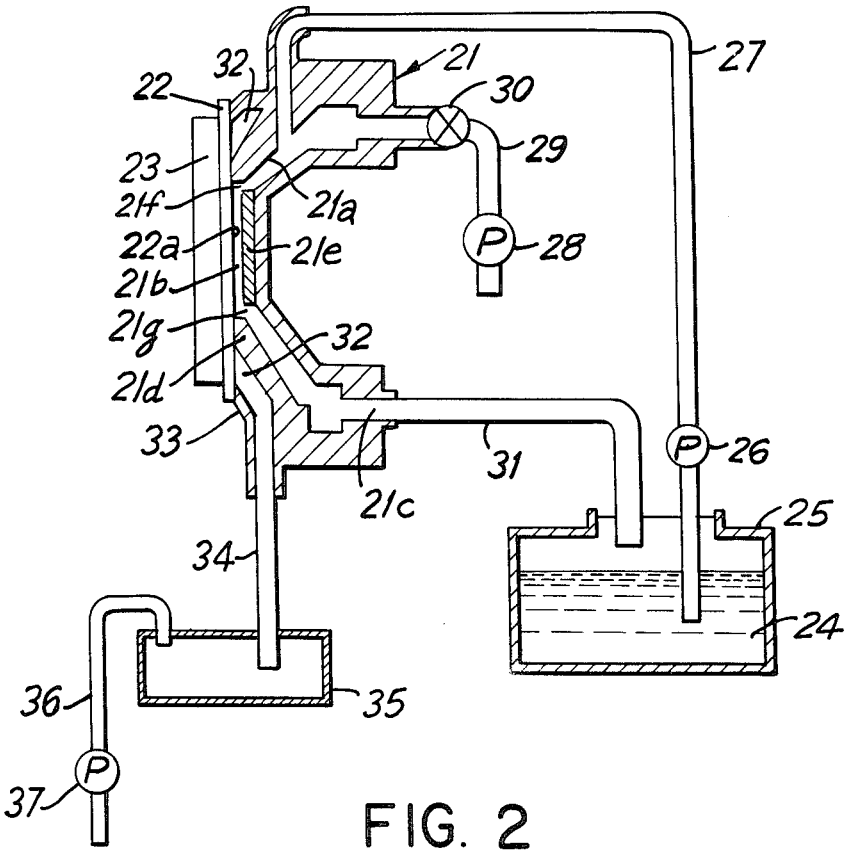
FIG. 2 shows a sectional view of an embodiment of this invention.

As shown in FIG. 2, developing head 21 is provided with a mask 21*a* which has an opening 21*b* with an area corresponding to one frame of electrophotosensitive material (hereinafter referred to as photosensitive material), in contact with the photosensitive material 22.

Photosensitive face 22*a* of one frame of photosensitive material 22 faces opening part 21*b*. When photosensitive material 22 is pressed by the holding plate 23 against developing head 21, an electrostatic latent image is developed by supplying liquid developer 24 through the opening part 21*b*.

Thereafter, removal of developer is performed by supplying air to photosensitive face 22*a*.

In a more detailed description, liquid developer 24 is pumped up from its storage tank 25 by pump 26, and it is transferred through route 27.

The air (gas) is transferred through route 29 which includes a means of compression having one end opened toward the atmosphere.

That is, a compression-transferring system is adopted for liquid developer 24 and air as opposed to the suction-system of the previously described conventional technology.

Route 29 for gas (air) is provided with a valve 30 to prevent the entry of liquid developer 24, compression-means 28 for gas (air), and route 29 for the gas (air) at the forced-transferring time of liquid developer.

After the developing process, the air and the excess liquid developer 24 which remained on photosensitive face 22*a* is returned to tank 25 through route 31 for discharge.

Thus, by supplying the pumped-up liquid developer 24 from the pump 26 to photosensitive face 22*a*, the latent image formed on photosensitive face 22*a* is developed, and squeezing is performed by applying ingested air on to the photosensitive face 22*a* by compression means 28 for the gas (air).

When such developing and squeezing processes are completed, the pressure of holding plate 23 against photosensitive material 22 is released, and photosensitive material 22 can be transferred from one frame to another. Also, the developing head of this invention is provided and formed with a pressure-reducing chamber 32 on the outside of opening frame 21*d* at the opening 21*b*. That is, a second surrounding frame 33 is provided on the outside of opening frame 21*d* formed at the outer edge of opening part 21*b*.

The end-face confronting photosensitive material 22 of the surrounding frame 33 is as high as the opening frame 21*d*, or it projects a little more than opening frame 21*d*, and its end face is in tight contact with photosensitive material 22. Also, pressure-reducing chamber 32 connects to a suction route 34, and the other end of suction route 34 connects to a trap 35.

Trap 35 is connected to suction route 36 which in turn is connected to suction pump 37.

The inner surrounding face of opening frame 21*d* which forms the outer frame of the above opening part 21*b* is perpendicular to the photosensitive surface 22*a* of the photosensitive material 22, and an inlet route 21*f* and an outlet route 21*g* for the liquid developer 24 and gas perpendicular to the photosensitive surface 22*a* are disposed between the inner peripheral surface and the end surface of a developing electrode 21*e* facing to the photosensitive surface 22*a* through a gap.

Figure 3A:
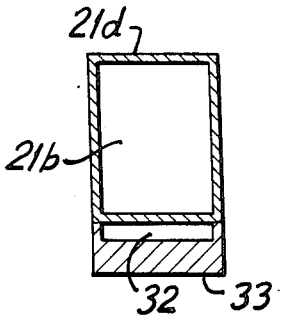
FIGS. 3(A), (B), (C), (D) are explanatory drawings demonstrating the pressure-reducing chamber in the developing head of this invention.
Figure 3B:
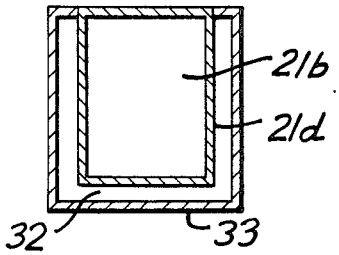
Figure 3C:
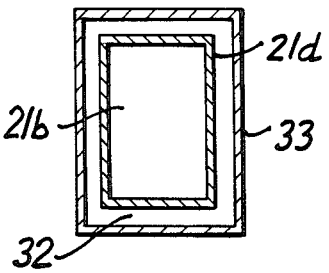
Figure 3D:
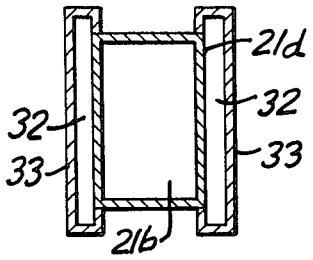

The position and shape of pressure-reducing chamber 32 around opening part 21*b* can be properly selected depening on the space of the developing chamber provided with pressure-reducing chamber 32 or other situations, for instance, pressure-reducing chamber 32 can be formed at the lower part of opening part 21*b* as shown in FIG. 3(A), or at the lower part and both sides of opening part 21*b* as shown in FIG. 3(B), or over the whole surrounding opening part 21*b* as shown in FIG. 3(C), or at both sides of opening part 21*b* as shown in FIG. 3(D).

For the case of a one-piece head, for example, with the charging chamber and the developing chamber in the vicinity, it is desirable to dispose the pressure-reducing chamber 32 at least at the side of the opening part 21*b* facing the charging chamber (FIG. 3(B), (C) and (D)), or over the entire periphery of the opening part 21*b* (FIG. 3(C)), in order to prevent entry of the liquid developer into the charging chamber at the time of squeezing.

Thus, the inside of the pressure-reducing chamber 32 is evacuated with the suction pump 36, and the liquid developer 24 oozing out of the opening frame 21*d* to the pressure-reducing chamber 32 is captured by the pressure-reducing chamber 32 and removed through a suction route 34 into a trap 35.

The reduced pressure in the pressure-reducing chamber 32 should usually be over 100 mm $H_2O$ or over 500 mm $H_2O$.

As shown in FIG. 3, pressure-reducing chamber 32 may be formed as a closed chamber, or it may be provided with a partial notch from which air can be induced for generating an air flow in pressure-reducing chamber 32, thus the discharge of sucked liquid developer 24 may be accelerated.

That is, pressure-reducing chamber 32 and the squeezing effect by flowing the gas (air) in opening 21*b*, make it possible to remove the remaining liquid around opening frame 21*d* with high efficiency.

Here, by improving smoothness of the surface of opening frame 21*d* by removing elevations over 1 $\mu$m, even higher efficiency can be obtained.

FIG. 4 shows the time relationships between the suction of pressure-reducing chamber 32 and the transference of photosensitive material 22.

The graph of FIG. 4(*a*) shows the continued suction in pressure-reducing chamber 32 from the time before starting the development until after the transference to the next process through the air blow for squeezing.

The graph of FIG. 4(*b*) shows the case of continued suction after starting the developing process up to the time before transference of photosensitive material 22 through the gas-blow for squeezing.

The graph of FIG. 4(*c*) shows the case of suction in pressure-reducing chamber 32 from the time after development up to the time before transference of photosensitive material 22.

In FIG. 4(*b*), the suction is stopped at the time of transference of photosensitive material 22, and suction force of photosensitive material 22, tightly attached to mask 22*a* of the developing chamber, is released, improving removal of photosensitive material 22 from mask 21*a*.

In FIG. 4(*c*), suction is stopped at the developing time, preventing massive suction of liquid developer 24 in pressure-reducing chamber 32, and a higher efficiency can be obtained by positioning opening frame 21*d* higher than surrounding frame 33. The developing head of this invention may control in either one of the types shown in FIGS. 4(*a*), (*b*) and (*c*) above.

In FIG. 4, it is possible to continue the gas-blowing for squeezing from immediately after development to the transference of photosensitive material.

Figure 5:
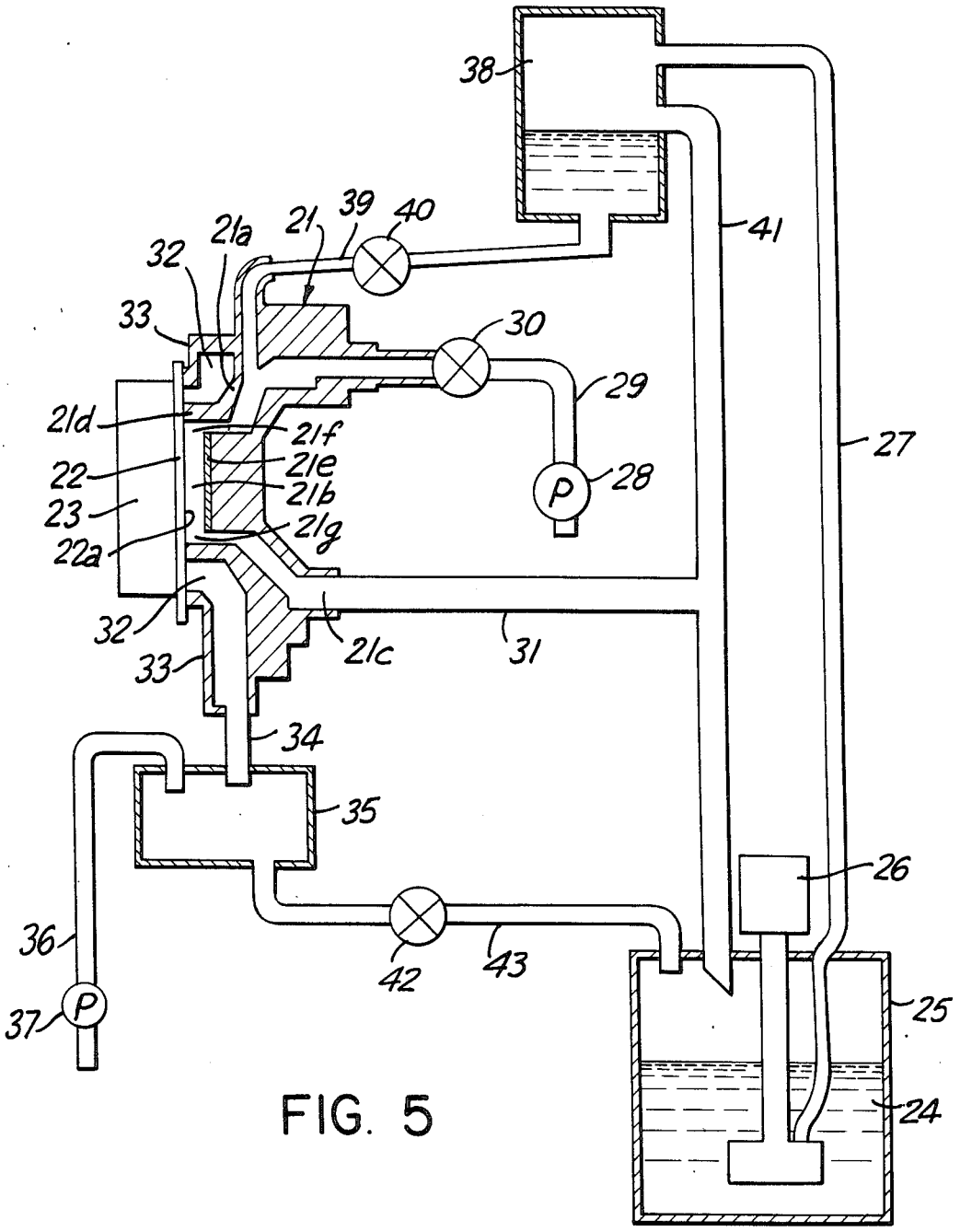
FIG. 5 is a sectional view illustrating another embodiment of this invention.

FIG. 5 shows another embodiment of this invention, in which functions are numbered similarly as in FIG. 2, and duplicate description is omitted.

In this embodiment, an auxiliary tank 38 is arranged at the upper side of opening part 21*b*, and route 27 for developer is connected to auxiliary tank 38.

At the bottom part of auxiliary tank 38, the route 39 is connected to in-flow route 21*f* through valve 40. Over-flow pipe 41 is provided to keep the level of liquid developer 24 in the auxiliary tank 38 constant, and overflow pipe 41 is connected to tank 25.

Liquid developer 24 is pre-stored in auxiliary tank 38 by pump 26, and developer 24 can be supplied to opening 21*b* by opening valve 40 during developing time.

Also, similar to the above mentioned embodiment, valve 30 is provided to prevent the entry of liquid developer 24 into the gas-compression-means 28, while it is not necessarily needed when the flow of liquid-developer 24 is less.

Liquid developer 24 and in-flow route 21*f* of the gas (air) for squeezing as well as its out-flow route 21*g* are at right angles to photosensitive face 22*a*.

Moreover, the position or shape of pressure-reducing chamber 32 is same as those of the above mentioned embodiment, and the pressure is reduced at chamber 32 as in the said embodiment by the similar timing.

The liquid developer 24 exuded through the contact face to photosensitive material 22 of opening frame 21*d* is sucked into the pressure-reducing chamber 32 and stored at trap 35. Trap 35 prevents the suction of liquid-developer 24 into the suction pump 37 directly, preventing the reduction of suction pump capacity.

Also, liquid developer 24 stored in trap 35 would be better returned to the tank 25 through the flow route 43 by opening the valve 42 at the resting time of suction pump 37.

As in the above, according to the embodiment in FIG. 5, it is possible to squeeze liquid developer 24 promptly using pressure-reducing chamber 32. In addition, because of the longer rectangularly facing part against the photosensitive material 22 of out-flow route 21*g* and in-flow route 21*f* of the gas (air) and liquid developer, more space can be taken for pressure-reducing chamber 32, and it is possible to prevent clogging of pressure-reducing chamber 32 by the deposition of solid matter in the developing agent or when there is a massive amount of liquid developer 24.

Furthermore, similar to the above mentioned embodiment, it is also possible to reduce the gap between the developing electrode 21*e* and photosensitive face 22*a* of photosensitive material 22 by securing the space of in-flow route 21*f* and out-flow route 21*g*.

Thus, squeezing efficiency can be increased by accelerating the flow-rate of gas (air) supplied during squeezing.

By setting up auxiliary tank 38, the liquid level of the developer 24 can be kept constant, and liquid can be transferred by gravity so the developing solution can always be transferred at a constant flow rate without being affected by flow changes such as pulsation of pump 26.

Also, it is possible to form a better picture image without developing unevenness by venting air-bubbles.

FIG. 6 shows an improved electrophotographic processing head 44 using the developing head of this invention. Head 44 incorporates means for electrostatic charging, developing, drying, and fixing in a one-piece head. A charging/exposure chamber 45 to perform both charging and exposure of the photosensitive material in the same place, a developing chamber 46 for development and squeezing, a drying chamber 47 to dry up the liquid developer by feeding a gas, and a fixing chamber 48 for fixing with a flash lamp, are laid out with intervals of a single frame image.

It is also possible to provide simultaneous and parallel processing by moving and stopping for each frame of 16 mm-electrophotographic film 49. Thus, by performing the electrostatic charging exposure to light, development, drying and fixing for many picture images continuously one-by-one, the processing interval for each frame can be shortened.

Further, a blip-sensor 50 on the side of processing head 44 detects blip-marks 51 provided on electrophotographic film 49, thus the desired frame survey and its movement is controlled.

In the above unified processing head, the electrostatic charging/exposure light chamber and drying chamber are adjacent to the developing chamber. If the liquid developer leaks out into the adjacent processing chambers, it stains other frame images or instruments arranged for other processes, and it may disturb the formation of a quality picture image.

A significant improvement can be obtained by providing the pressure-reducing chamber of this invention at the developing chamber of the unified processing head as shown in FIG. 6.

As described in detail in the embodiments, the following benefits can be obtained by this invention.

(1) With the established pressure-reducing chamber on the outside of the opening, the liquid developer remaining after the developing process can be sucked and removed efficiently, thus it is possible to shorten the image processing time.

(2) Even when the opening is incompletely sealed due to dust on the opening frame, the leaked liquid-developer is only sucked into the pressure-reducing chamber, and air from that part does not enter the opening. Thus it is possible to prevent developing pictures unevenly due to admixture of air.

(3) In-flow routes and the out-flow route of the gas for squeezing and liquid developer are arranged at a right angle to the photosensitive face. Thus, when the size of developing electrode or opening part is constant, it is possible to reduce the gap between the photosensitive face and the developing electrode, and higher speeds can be obtained for the gas or the developing process.

(4) Liquid developer is sprayed against the photosensitive face at right angles so the area of liquid developer directly in contact with the photosensitive face is reduced, and it is possible to inhibit the occurrence of uneven image concentration.

(5) Further, the opening frame for partitioning the opening chamber and pressure-reducing chamber can be easily manufactured of hard materials (e.g. metals, resins and ceramics, etc.), with higher durability and reliability.

While preferred embodiments have been described, variations thereof will occur to those skilled in the art within the scope of the present invention concepts which are delineated in the following claims.

We claim:

1. A developing head for a photosensitive face of electrophotosensitive material, in an electrophotographic system, comprising: means at said head for defining an opening including a first frame in front of said photosensitive face, means for supplying a liquid developer to said opening, means for supplying gas to said opening for removing liquid developer therefrom, said means for supplying said developer and said gas including a flow route perpendicular to the photosensitive face, a pressure-reducing chamber in said head adjacent said first frame, pressure-reducing means for evacuating said chamber, and a second frame around said pressure-reducing chamber for tightly contacting the photosensitive face.

2. A developing head as claimed in claim 1, wherein said first frame is rectangular and forms an outer edge of said opening.

3. A developing head as claimed in claim 1, comprising trap means interposed between said pressure-reducing chamber and said pressure-reducing means.

4. A developing head as claimed in claim 1, wherein said supplying means for said developer comprises an auxiliary tank positioned at a level above said opening.

5. A developing head as claimed in claim 1, wherein said pressure-reducing means forms in said pressure-reducing chamber a pressure of over 100 mm $H_2O$.

6. A developing head as claimed in claim 1, comprising an electrostatic charge chamber for charging said electrophotosensitive material, and said pressure-reducing chamber is disposed at a side of said opening facing said electrostatic charge chamber.

7. A developing head as claimed in claim 1, wherein said pressure-reducing chamber is rectangular and located below said opening.

8. A developing head as claimed in claim 1, wherein said pressure-reducing chamber is rectangular and surrounds said opening on all sides.

9. A developing head as claimed in claim 1, wherein said pressure-reducing chamber surrounds said opening on three sides.

10. A developing head as claimed in claim 1, wherein said pressure-reducing chamber has two partial chambers on two opposite sides of said opening.

* * * * *